US010746196B2

(12) United States Patent
Kenworthy et al.

(10) Patent No.: US 10,746,196 B2
(45) Date of Patent: Aug. 18, 2020

(54) METHODS AND DEVICES FOR REDUCING CIRCUMFERENTIAL PRESSURE IMBALANCES IN AN IMPELLER SIDE CAVITY OF ROTARY MACHINES

(71) Applicant: Technology Commercialization Corp., Chester, VT (US)

(72) Inventors: Michael W. Kenworthy, Chester, VT (US); Boris Ganelin, Brooklyn, NY (US)

(73) Assignee: Technology Commercialization Corp., Chester, VT (US)

( * ) Notice: Subject to any disclaimer, the term of this patent is extended or adjusted under 35 U.S.C. 154(b) by 119 days.

(21) Appl. No.: 15/696,230

(22) Filed: Sep. 6, 2017

(65) Prior Publication Data

US 2018/0291928 A1 Oct. 11, 2018

Related U.S. Application Data

(60) Provisional application No. 62/483,407, filed on Apr. 9, 2017.

(51) Int. Cl.
*F01D 5/00* (2006.01)
*F04D 29/66* (2006.01)
(Continued)

(52) U.S. Cl.
CPC ..... *F04D 29/66* (2013.01); *F04D 29/2261* (2013.01); *F04D 29/2266* (2013.01);
(Continued)

(58) Field of Classification Search
CPC .. F04D 29/66; F04D 29/2261; F04D 29/2266; F04D 29/42; F04D 29/44; F04D 29/662; F04D 29/668
(Continued)

(56) References Cited

U.S. PATENT DOCUMENTS 3,364,866 A * 1/1968 Sato ..... F04D 13/0666 384/122
3,589,827 A * 6/1971 Gerasimenko ..... F04D 29/042 415/106
(Continued)

OTHER PUBLICATIONS

Armin Zemp. Inlet flow distortion in a centrifugal pump. Master's Thesis. Jun. 2007.
Y. Senoo-Kyushu. Vaneless diffusers. May 1984.

*Primary Examiner* — Hung Q Nguyen
*Assistant Examiner* — Anthony Donald Taylor, Jr.
(74) *Attorney, Agent, or Firm* — Boris Leschinsky

(57) ABSTRACT

An improved rotary machine of the invention may include a rotor with an impeller mounted thereon. A side cavity may be formed between an impeller and the housing. The rotary machine may be further equipped with an annular subdividing disc for segmenting a fluid flow in the cavity into a first fluid flow between the disc and the impeller, and a second fluid flow on the other side of the disc between the disc and the housing. The rotary machine of the invention also features a peripheral annular space formed in the periphery of the housing in the cavity at a location adjacent to a peripheral region of the annular subdividing disc. Importantly, this peripheral annular space is void of restrictions to circumferential fluid flow therein so as to alter the second fluid flow in the cavity in order to reduce pressure variations and flow disturbances along the circumference of the rotary machine. This in turn improves rotational balance of the rotary machine.

12 Claims, 6 Drawing Sheets

(51) Int. Cl.
*F04D 29/44* (2006.01)
*F04D 29/42* (2006.01)
*F04D 29/22* (2006.01)

(52) U.S. Cl.
CPC ..... *F04D 29/42* (2013.01); *F04D 29/44* (2013.01); *F04D 29/662* (2013.01); *F04D 29/668* (2013.01)

(58) Field of Classification Search
USPC ..... 415/170
See application file for complete search history.

(56) References Cited

U.S. PATENT DOCUMENTS 4,493,610 A * 1/1985 Iino ..... F01D 25/04 384/111
4,538,960 A * 9/1985 Iino ..... F01D 3/04 415/104
4,793,777 A * 12/1988 Hauenstein ..... F04D 29/0416 417/365
5,106,262 A * 4/1992 Oklejas ..... F01D 5/048 415/111
5,320,482 A * 6/1994 Palmer ..... F04D 29/0416 415/104
5,385,442 A * 1/1995 Lehe ..... F04D 29/2266 415/104
6,129,507 A * 10/2000 Ganelin ..... F01D 3/00 415/1
7,731,476 B2 * 6/2010 Ganelin ..... F01D 3/00 415/104
7,775,758 B2 * 8/2010 Legare ..... F01D 3/04 415/1
7,775,763 B1 * 8/2010 Johnson ..... F04D 29/167 415/111
10,167,874 B2 * 1/2019 Danguy ..... F04D 7/02
2017/0260987 A1 * 9/2017 Onodera ..... F04D 27/0215

* cited by examiner

METHODS AND DEVICES FOR REDUCING CIRCUMFERENTIAL PRESSURE IMBALANCES IN AN IMPELLER SIDE CAVITY OF ROTARY MACHINES

CROSS-REFERENCE DATA

This application claims a priority benefit from a U.S. Provisional Patent Application No. 62/483,407 filed 9 Apr. 2017 by the same inventors and entitled "Perimeter Diffuser of Impeller Side Cavity for Rotary Machine", which is incorporated herein in its entirety by reference.

BACKGROUND

Field of the Invention

Without limiting the scope of the invention, its background is described in connection with rotary machines. More particularly, the invention describes a rotary machine with improved diffusion of distortions within the secondary flows.

Rotary machines are used in a variety of industries. Centrifugal compressor and pumps, turbo-pumps, gas, and jet engines and pumps, and hydraulic motors are some examples of rotary machines. A typical single- or multi-staged centrifugal rotary pump or compressor contains a generic rotating rotor surrounded by a stationary shroud or housing. A primary working part of the rotor (which is sometimes also called an impeller), typically contains an arrangement of vanes, discs and/or other components forming a pumping element that while rotating increases the energy of the pumping fluid. The rest of the description below refers to the turning part of the rotary machine as the impeller.

Description of the Prior Art

While offering many benefits (efficiency, reliability, etc.), centrifugal rotary machines typically require operating within a tighter operating range than other types of rotary machines. They are designed to operate preferably at a capacity or rotational speed that maximizes the efficiency of the rotary machine known as the "best-efficiency point", or BEP. Negative rotational dynamic events are highly associated with operating away from BEP.

One known method to increase efficiency and to permit reducing the size of the volute of a rotary machine is to install stationary vanes in the diffuser to redirect flow immediately downstream of the impeller. The flow leaving the rotating impeller has a high tangential component, and such stationary vanes in the diffuser may efficiently convert this kinetic energy into potential energy (increased pressure). But a key limitation of utilizing stationary vanes in the diffuser is to further narrow down the preferred operating range of the centrifugal pump or compressor.

In centrifugal pumps or compressors having a diffuser equipped with stationary vanes, the design of the vanes of the rotating impeller is matched to the stationary vanes of the receiving diffuser within the stationary housing for a specific rotational speed defining BEP. When not operating at the BEP, the incidence angle of the flow leaving the impeller vanes does not match the receiving angle of the stationary diffuser vanes, resulting in a reduction in efficiency, as well as causing flow instabilities because the geometric configuration of the impeller and the diffuser no longer provide for an optimum flow pattern. Consequently, there are changes in the flow field within the pump or compressor, including flow separation and regions of localized, non-uniform, unsteady flow as well as pressure variations along the periphery of the rotary machine. These unevenly distributed flow and pressure interacts with rotating and stationary components inside the pump or compressor, creating pressure and force disturbances and potentially a hydrodynamic excitation. During partial-flow operation in particular, local hydrodynamic and global hydro-acoustic excitations are indicated by the vibrations of such rotary machines. There is a need to reduce such pressure variations and provide for a greater rotational balance of a rotary machine.

When operating a centrifugal pump or compressor, even assuming a fully axisymmetric rotor, pressure distribution in the peripheral region of the impeller side cavities is typically non-uniform circumferentially, especially at the area of flow outlet. In the last stage of centrifugal pumps and compressors, the impeller delivers fluid into a volute. All volutes have at least one tongue, and sometimes two tongues or more. A tongue creates asymmetric flow patterns in the spiraling volute, especially when operating at partial load. Also, all stages of a rotary machine are subject to migration of flow distortions in upstream and downstream stages (or variances in fluid supply), which typically causes circumferential variations and disturbances in pressure at impeller exit. Examples of such conditions include surge and stall. The greater the extent of circumferential pressure variations especially at impeller exit, the greater the net radial force on the rotor, increasing its radial orbit and disturbing its rotational balance.

A further consideration impacting rotational balance of a rotary machine is a significant circumferential variation in the extent of fluid leakage flowing through an annular gap (9) (see FIG. 1) at the impeller periphery. First, the size of such annular gap varies circumferentially, given the radial orbit of the rotor motion within the stationary housing. Second, the radial location of the greatest space defining the annular gap is typically the same as a location of the greatest local fluid pressure in the adjacent section of the volute, further adding to the circumferential imbalance in the transit leakage flowing through the gap. These circumferential imbalances often result in destabilizing forces at the wear ring (also called an eye seal) and along the rotating impeller shroud surface, potentially causing rotational dynamic performance and imbalance problems and reducing the life of the rotary machine.

Operating centrifugal pumps at off-BEP is reviewed in depth in an article entitled *Pressure Distribution Between the Impeller Shroud and the Casing of a Centrifugal Pump with Volute*, authored by F. Bahm and A. Engeda at InterSym AIF, Fourth International Symposium on Experimental and Computational Aerothermodynamics of Internal Flow, in 1999 in Dresden, Germany, incorporated herein in its entirety by reference. In a single stage end suction centrifugal pump, the authors placed pressure probes along the impeller shroud uniformly distributed over 4 radii at 6 angles within the front cavity, as well as at 4 positions over the circumference on the suction side of the wear ring.

The findings of these experiments included identification of a "clearly non-uniform pressure distribution in the volute". The article concludes that "These observations suggest that non-uniform peripheral pressure distribution at off-design point also affects the flow processes in the front cavity." While during operation at BEP, "the behavior of the peripheral static pressure is almost uniform", "notable departures from uniformity between 350° and 40° lie in the region of influence of the volute tongue." The article also notes that "the observed influence of the volute tongue on the flow intensifies in off-design operation and is particularly pronounced at part-load operation."

With regard to the radial pressure distribution in the impeller side cavity, the article continues to state that "the radial pressure drop is almost rotationally symmetrical only at the design point". But at off-design operation, "it is clearly evident that the radial pressure drop in the front cavity is non-uniform over the circumferential angle". The radial forces acting on the impeller in partial load and overload circumstances may thus be considered as a possible factor leading to a change in the wearing-ring clearance geometry and hence to varying peripheral flow resistances through the gap between the shroud and the impeller.

To summarize, during off-design operations, pressure variations at the diffuser/volute entrance change circumferentially, thereby altering the net radial forces (both in magnitude and direction) acting on the impeller. Increases in net radial forces on the rotor cause a rise in eccentricity of its radial orbit. This eccentricity in turn alters the circumferential annular gap at the wear ring and the impeller tip. This reflects the dynamic nature of the flow through the gap, resulting in fluctuating circumferential imbalances.

As mentioned above, centrifugal pumps and compressors that do not have stationary vanes immediately downstream of the impeller operate safely over a broader operating range, but at the expense of lower efficiency. The stationary vanes of the housing channel and segment the flow path into multiple spiraling flow paths, inherently restricting circumferential diffusion. This channeling impedes the dissipation of circumferential imbalances and variations in pressure and fluid flow within the diffuser/volute. These imbalances migrate upstream and downstream during operation away from BEP, affecting rotational dynamic performance.

Advanced design features for centrifugal rotary machines are disclosed in U.S. Pat. Nos. 6,129,507 and 7,731,476 incorporated herein by reference in their respective entireties. Design features are described for the impeller side cavity(s) (front and/or back) that can be used in any one or several stages of a centrifugal pump or compressor for the main purpose of reducing and controlling axial thrust.

The need exists therefore for methods and devices to reduce the circumferential variations of pressure in the impeller side cavities of rotary machines. The need also exists for a rotary machine with high efficiency and broad operating range while maintaining rotational balance of the impeller.

SUMMARY OF THE INVENTION

Accordingly, it is an object of the present invention to overcome these and other drawbacks of the prior art by providing novel methods and devices to improve rotational balance of a rotary machine.

It is another object of the invention to provide novel methods and devices to improve circumferential smoothing, averaging, normalizing, equilibration and/or diffusion of localized pressure variations and flow distortions within the side cavities in rotary machines, in particular in those machines having an annular subdividing disc in an impeller side cavity.

It is a further object of the present invention to provide novel methods and devices for a rotary machine capable of varying the extent of circumferential averaging, normalizing, equilibration and/or diffusion of secondary flows in the rotary machine.

It is yet another object of the present invention to provide new methods and devices for a rotary machine aimed at adjusting local flow and pressure disturbances in a vicinity of one or more tongues so as to improve rotational balance of the rotary machine.

It is yet another object of the present invention to provide new methods and devices for a rotary machine configured to adjust for circumferential non-uniformity of pressure and flow in the diffuser/volute caused by upstream or downstream affects in the rotary machine.

The present invention relates to methods and devices for reducing fluid-induced rotational dynamic disturbances in rotary machines, thereby reducing axial and radial vibrations and oscillations of the rotor and permitting safe operation further away from the best efficiency point (BEP).

More specifically, the present invention relates to centrifugal rotary machines having an annular stationary disc (referred to as "subdividing disc" throughout this description) located in the side cavity between the rotating impeller (either shrouded or unshrouded) and the housing for the purpose of separating the outward flow in the side cavity along the rotating impeller from inward flow toward the hub along the housing wall, and thereby altering the nature of the flow dynamics along the outside periphery of the rotating impeller shroud (i.e., the annular space between the annular subdividing disc and the rotating impeller shroud) and at the entrance of the wear ring (eye seal).

According to the present invention, provided is a peripheral annular space sized and configured to encourage free circumferential flow along the periphery of the housing. This annular space is free of any restrictions to circumferential flow and serves to absorb all transit leakage fluid flows from the main annular gap flow as well as the fluid centrifuged outward along the rotating impeller. Absorption of all flows into a single peripheral circumferential flow causes various pressure and flow variations to average, normalize or equilibrate circumferentially prior to being directed toward the hub by redirecting stationary vanes. These stationary vanes may be located within the annular space between the annular subdividing disc and the housing wall (together, defining a system of return channels for secondary flow). As a result, rotational dynamic stability is improved by providing more uniform flow conditions in the side cavity adjacent the rotating impeller and at the entrance to the wear ring.

To improve simplicity of the rotary machine and to reduce the cost of manufacturing, the redirecting stationary vanes may be incorporated with the stationary disc for subdividing the fluid flow as a single unit for a fixed attachment to the housing.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION OF THE FIRST EMBODIMENT OF THE INVENTION

Figure 1:
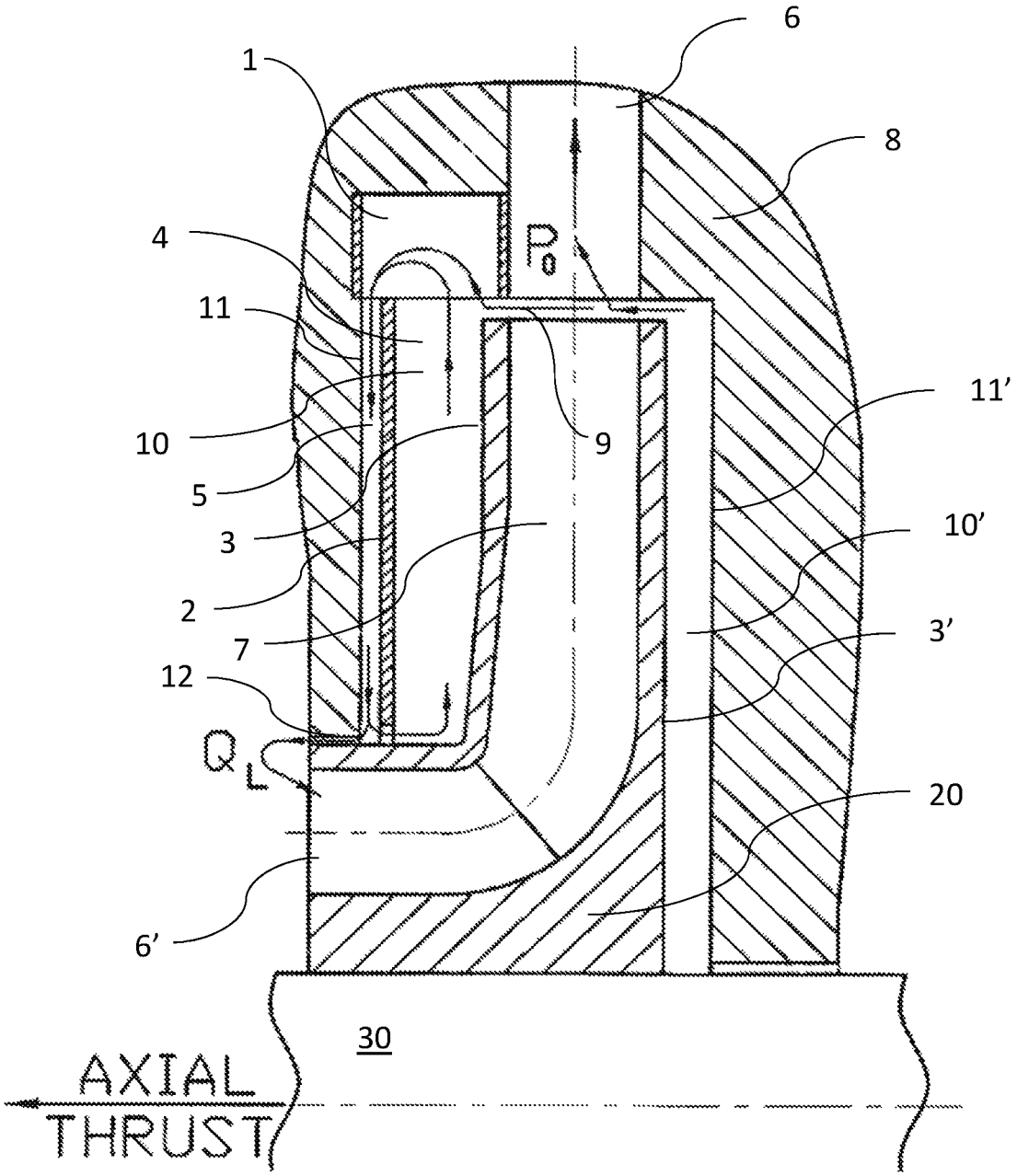
FIG. 1 (PRIOR ART)
FIG. 1 is a cross-sectional view of an upper half portion of a rotary machine (outer peripheral portion of the impeller) of the prior art design.

The following description sets forth various examples along with specific details to provide a thorough understanding of claimed subject matter. It will be understood by those skilled in the art, however, that claimed subject matter may be practiced without one or more of the specific details disclosed herein. Further, in some circumstances, well-known methods, procedures, systems, components and/or circuits have not been described in detail in order to avoid unnecessarily obscuring claimed subject matter. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

FIG. 1 shows an upper half portion of a cross-section of a rotary machine of the prior art containing a housing (8) and an impeller (20) fixedly placed on the central shaft (30). The impeller (20) includes a front disc (3) shown to the left side of the FIG. 1 and the rear disc (3') shown to the right of the FIG. 1 so that these discs serve to direct the fluid flow from the low pressure area at the inlet (6') to the high pressure area at the outlet (6) of the impeller (20).

Two cavities are formed between the impeller (20) and the housing (8): a front cavity (10) and a rear cavity (10'). Front cavity (10) is defined generally by the front interior housing wall (11) and the front disc (3). Rear cavity (10') is defined respectively by the rear interior housing wall (11') and a rear disc (3'). Cumulative axial thrust on the impeller (20) is a result of the pressure distribution along the front disc (3) and the rear disc (3') in these two respective cavities (10) and (10'). In turn, these pressure distributions directly depend on the fluid dynamics in these cavities, the discussion of which will now follow.

The annular subdividing disc (2) in the impeller side cavity (10) and other features such as the impeller front shroud and back hub portions are generally shown in the drawings as perpendicular to the rotor axis for convenience of presentation, while conical or curved surfaces and gaps formed therebetween are more common in practice. And while the specification and the drawings herein indicate impellers having a front shroud, the present invention also has application for rotary machines having unshrouded impellers. Also, such design features as described in any one of the drawings below may be used in any combination with those of the other figures as described herein or with any other features in the '507 and '476 patents mentioned above.

The annular subdividing disc (2) is shown only on the front cavity also for convenience of the presentation. A similar annular subdividing disc may also be installed in the rear cavity (10') or both the front cavity and the rear cavity of the rotary machine.

Also provided are stationary subdividing vanes (1) located near the fluid exit of the impeller (20). In a prior art rotary machine, the fluid exit flow is traditionally divided into a rotary machine outlet flow directed towards the outlet (6) and an annular flow (9) directed towards the front cavity (10) defining a leakage flow $Q_L$ through an impeller wear seal or wear ring (12). Stationary vanes (1) redirect the annular flow and send it down the front cavity (10) towards the center of the rotary machine. An annular subdividing disc (2) separates the flow into a first flow (5) between the housing wall (11) and the annular subdividing disc (2) and a second flow (4) between the annular subdividing disc (2) and the front impeller disc (3).

A detailed description of the present invention follows with reference to the accompanying drawings in which like elements are indicated by like reference numerals. The figures illustrate a portion of one of the stages of a typical rotary machine that may contain one or more stages. The pumping element of the rotor is sometimes referred to as the impeller. Although the geometry of the impeller may vary according to the pumping conditions, such as in so-called radial, mixed flow or axial pumps, they all have the same basic elements, namely the impeller having a front disc and a rear disc, a housing containing that impeller, and seals minimizing the leaks from the high pressure areas at the outlet of the rotary machine to the low pressure areas at the inlet of the rotary machine. The present invention is illustrated only with reference to the radial flow type centrifugal pump, but it can be easily adapted by those skilled in the art to other types of rotary machines.

Figure 2:
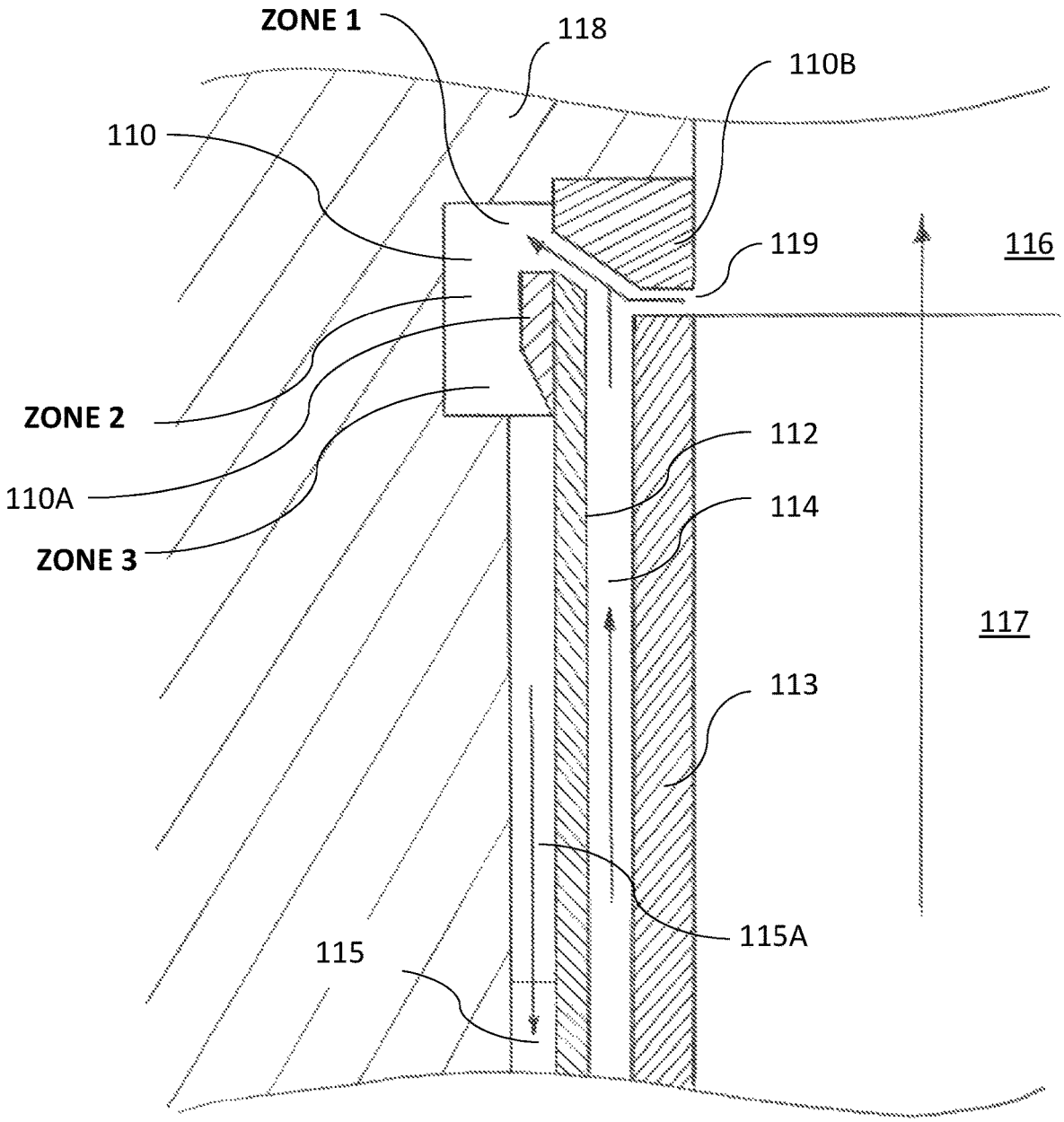
FIG. 2 is a cross sectional view of a left upper corner portion of a rotary machine (outer peripheral portion of the impeller) near an impeller exit incorporating a first embodiment of the invention.

A cross-sectional view of the first preferred embodiment of the present invention is depicted in FIG. 2. Shown here is an exemplary close-up view of the upper corner of the rotary machine (outer peripheral portion of the impeller) near the fluid exit so as to illustrate the novel elements of the invention installed in this location. Similar design elements may also be installed in other suitable locations of a rotary machine.

The present invention may be preferably utilized on one or both side cavities of a single stage rotary machine, or in the front or both side cavities of each stage of a multi-stage rotary machine. It is assumed that in the side cavity there is net transit leakage flow entering the impeller side cavity through annular impeller tip gap (119) and exiting through the impeller wear ring (not shown).

The main fluid flow (117) through the impeller is propelled by impeller vanes having a front disc (113) defining in a periphery an impeller tip gap (119) with a peripheral annular ring (110B), which is fixedly attached to or formed together with a stationary housing (118). An annular subdividing disc (112) together with annular bypass channel redirecting vanes (115A) may be fixedly attached to the housing (118), together comprising a return channel for a secondary flow.

During operation, the rotation of the impeller (including impeller front disc (113)) propels fluid in the main flow (117) into the diffuser/volute (116) that circumferentially encompasses the impeller and further down the outlet of the rotary machine. A small portion of that flow leaks through an annular gap (119) formed between the impeller disc (113) and the annular ring (110B) from the area of high pressure towards the area of low pressure—shown in FIG. 2 by arrows. This transit leakage through the annular gap (119) has a high tangential velocity and high pulsation quality due to jet/wake pulses caused by the impeller vanes. The inner side of annular ring (110B) forms the outer boundary of an annular channel for such transit leakage flow, while the outer side of the annular subdividing disc (112) forms the inner boundary of this annular flow. The annular flow is directed into a peripheral annular space (110). Fluid in impeller side cavity (114) is centrifuged outward and tangentially by the rotating impeller front disc (113), causing it to also flow through the same annular channel to the peripheral annular space (110).

As compared to the prior art having virtually no or a very small peripheral annular space (110), the inventors of the present invention unexpectedly discovered that providing an annular space (110) which is designed for and sized sufficiently large to allow fluid to move tangentially around the periphery of the rotary machine housing with little to no resistance provides significant benefits in reducing rotational imbalance and smoothing out pressure variations and flow irregularities for a rotary machine.

Fluid in the peripheral annular space (110) exits into annular bypass channel (115) from which it is directed toward the center of the rotary machine. Annular bypass channel redirecting vanes (115A) may be provided within annular bypass channel (115), redirecting incoming peripheral fluid having a high tangential flow component into predominantly radially inward flow toward the impeller shaft. The annular bypass channel redirecting vanes (115A) may occupy all or part of annular bypass channel (115), including potentially more than one set of stationary vanes.

Given that the perimeter side of the peripheral annular space (110) is spaced further away from the rotor axis than the annular gap (119), all annular gap leakage having high tangential velocity will proceed into the peripheral annular space (110). Fluid centrifuged outward by the rotating impeller front disc (113) also having high tangential velocity will also proceed into the more distal peripheral annular space (110).

The peripheral annular space (110) may be specifically designed to facilitate the averaging or normalization of circumferential distortions, including variations in localized pressure, fluid momentums and turbulence of the fluid in the peripheral annular space (110). Fluid entering peripheral annular space (110) has a high degree of flow variations in the normal direction (e.g., vortices), and will initially gravitate to the most distal portion of the peripheral annular space (110). With residence time, vortex lines initially normal to the flow will be tipped into the streamwise direction as they traverse this space. The three-dimensional flow in the distal region of peripheral annular space (110) will become more and more two-dimensional and uniform as the flow migrates to the inner portion of the peripheral annular space (110)—and just prior to being directed to the annular bypass channel redirecting vanes (115A).

Circumferential averaging of pressure may be further aided by the repetitive process of:

a. a reduction in swirl velocity given a greater radius of a distal portion of peripheral annular space (110), followed by
b. an acceleration of swirl as the fluid migrates toward the more proximate (closer to the central shaft) region of peripheral annular space (110) due to a law of conservation of energy,
c. just prior to entry into the annular bypass channel redirecting vanes (115A).

The dimensions of peripheral annular space (110) should be sufficiently large to permit the flow of fluid without appreciable resistance in the circumferential direction to enable the averaging of pressure circumferentially. To enable such circumferential flow without appreciable resistance, the inner radius of the peripheral annular space (110) may be selected to be from about ½ the distance between the radius of the impeller tip and that of the wear ring, to about the full radius at the impeller tip. In addition, the outer radius of the peripheral annular space (110) may be as large as that of the volute downstream of the impeller. Further, the width of the peripheral annular space (110) may be as large as one to three times the combined width of the impeller side cavity (114) and bypass return channel (115).

An optional annular ring (110A) may be provided and fixedly attached to (or formed therewith) the annular subdividing disc (112). The annular ring (110A) provides two functions. First, it may increase a mechanical strength of the annular subdividing disc (112), which may be required since the annular subdividing disc (112) extends outward beyond the support of the annular bypass channel redirecting vanes (115A), which may be fixedly attached to the housing (118). Second, given its protrusion into a generally rectangular cross section of the peripheral annular space (110), the annular ring (110A) alters the profile of the peripheral annular space (110), affecting flow dynamics within thereof.

As flow in the peripheral annular space (110) having a high normal flow component becomes more two-dimensional, it gravitates toward the inner side thereof, and due the smaller radius gains swirl velocity. This is the case assuming a uniform width of the annular peripheral space (110). A presence of the annular ring (110A) may alter the width along peripheral annular space (110), resulting in three separate annular regions varying in radial distance to the center of the rotary machine. The most distal portion of the annular region (Zone 1) is most distal to the annular ring (110A) having a maximum width and providing the greatest volumetric area for the normalization of flow. In Zone 1, more two-dimensional (uniform) flow will gravitate toward its inner radius. The area radially adjacent to the annular ring (110A) defines Zone 2 with the step reduction in width produced by the presence of the annular disc (110A). The resulting resistance for fluid to enter Zone 2 "bottles up" flow in Zone 1, forcing an even greater normalization of fluid distortions in Zone 1. Within Zone 2, more two-dimensional (uniform) flow gravitates toward its inner radius, having greater tangential velocity than the bulk velocity of fluid in Zone 1. Zone 3 is most proximate to the impeller center axis, with the width of the annular ring (110A) tapering from full width to zero at the entrance to annular bypass channel (115). This tapering in effect increases the width of the peripheral annular space (110) available for fluid flow in its proximate annular region, causing a reduction in the swirl velocity as the fluid approaches the annular bypass channel (115) and enters the annular bypass channel redirecting vanes (115A). Similar effects of altering the swirl velocity in the peripheral annular space (110) by altering its width may be achieved by altering the profile of the other side of peripheral annular space (110) (i.e., the left side in FIG. 2) as shown in further detail in FIG. 3.

With respect to providing circumferentially more uniform pressure and flow mass/volume distribution conditions at the wear ring and in the impeller side cavity to improve rotational dynamic performance, one other novel design feature may be incorporated. The main flow (117) generally exits the rotating impeller and enters the volute (116). Volutes may be not symmetrical. They all have a tongue (typically one, and sometimes two). A tongue inherently causes circumferential variances in the pressure and flow at the entrance to the volute. The annular peripheral space (110) and the bypass channel redirecting vanes (115A) are stationary components, like the tongue(s) of the volute. They may be designed to be non-uniform circumferentially to compensate for or correct the circumferentially non-uniform effects of the tongue(s). In embodiments, such design modifications may include circumferentially:

a. altering the density (per radial span) or pitch of the bypass channel redirecting vanes (115A), or
b. altering the dimensions of the annular peripheral space (110) such as varying respective radii of the distal and proximate walls thereof, or
c. varying the width or cross section area of the annular bypass channel (115), all such modifications utilized to alter or vary local flow resistance around the circumference of the peripheral annular space (110). Various circumferential variations/alterations in surface quality (roughness, etched vanes, etc.) may also be utilized to compensate for the circumferential imbalance inherently present in the vicinity of the tongues of the housing volutes.

DETAILED DESCRIPTION OF THE SECOND EMBODIMENT OF THE INVENTION

Figure 3:
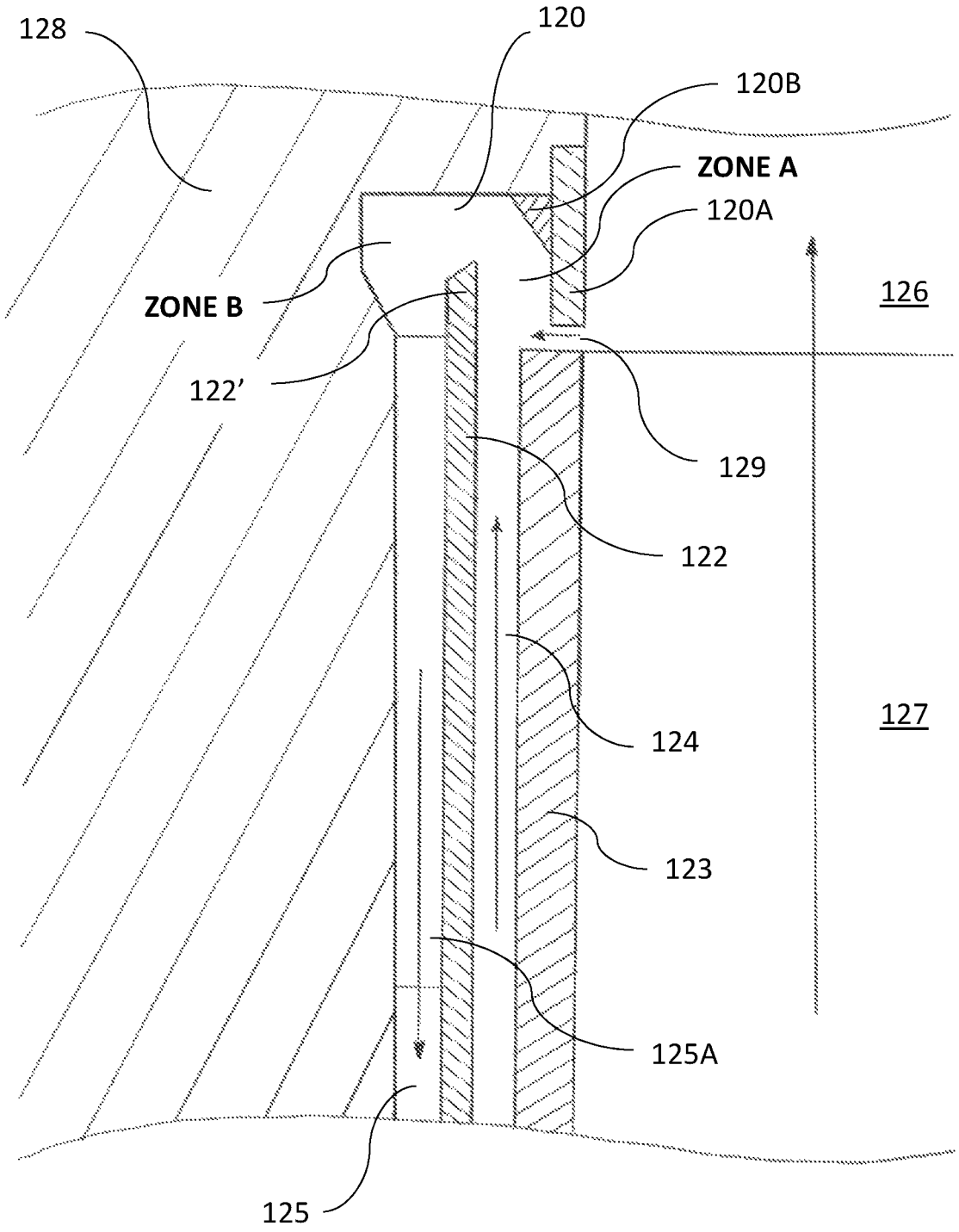
FIG. 3 is a cross sectional view of a left upper corner portion of a rotary machine (outer peripheral portion of the impeller) near an impeller fluid exit incorporating a second embodiment of the invention.

A cross-section view of the second embodiment of the present invention showing a fragment of a rotary machine next to the outlet of the impeller is depicted in FIG. 3. The benefits of the second embodiment include: (1) improved flow dynamics, (2) a more compact design, and (3) lower production costs.

During operation of the rotary machine, the rotating impeller (including impeller front disc (123)) propels the impeller main flow (127) towards the diffuser/volute (126) that may circumferentially encompass the impeller. Transit leakage flows through the annular gap (129) and has high tangential velocity. The annular leakage then moves into a radially more distal or distant region of the peripheral annular space (120) which is bounded by annular ring (120A). Fluid in impeller side cavity (124) is centrifuged outwardly and tangentially by rotating impeller front disc (123). Its outward and tangential momentum carries the fluid past the impeller tip and into the radially more distal region of the peripheral annular space (120). Fluid in peripheral annular space (120) exits into annular bypass channel (125), and then moves radially inward toward the hub area of the center of the rotary machine (not shown). Annular bypass channel redirecting vanes (125A) may be contained within the annular bypass channel (125). They may also share the same annular cavity area and configured for redirecting incoming fluid having a high tangential flow component into largely radial inward flow toward the hub.

The flow dynamics in peripheral annular space (120) develops as follows. The annular subdividing disc (122) extends radially outward beyond the point where it may be fixedly attached to the annular bypass channel redirecting vanes (125A), forming a protrusion (122') into peripheral annular space (120). Such protrusion of the annular subdividing disc (122) causes formation of two side-by-side annular zones, which are partially separated from each other by the disc (122). The area within peripheral annular space (120) and to the right of the most distal surface of annular subdividing disc (122) in FIG. 3 defines Zone A. The area to the left of the most distal surface of annular subdividing disc (122) defines Zone B. Zone A receives fluid entering into peripheral annular space (120), and fluid exits peripheral annular space (120) via Zone B. Fluid entering Zone A from annular side cavity (124) is centrifuged radially outward by rotating impeller front disc (123) and has high tangential and radial velocity, and fluid entering through annular gap (129) has high tangential velocity. The momentum of these two entering fluid flows having a high degree of flow normal to the flow path is carried to the most distal portion of peripheral annular space (120) where it blends with the fluid already present in Zone B.

Several features shown in FIG. 3 may be utilized to facilitate the movement of the fluid from Zone A to Zone B in their distal (most peripheral) region. First, the annular ring (120B) may be inserted and shaped to gradually reduce the width of Zone A with larger radius, resulting in the most distal region of peripheral annular space (120) being most occupied by Zone B, such distal region having the most non-normal flow. Second, the left outer wall of Zone B may be design to extend to the left of the annular bypass channel (125), increasing the volume of Zone B and especially at its most distal region. This may have an effect of similarly further increasing the distal area of peripheral annular space that is occupied by Zone B. And third, the protrusion portion (122') of the annular subdividing disc may be made beveled so that its most distal edge is on its right side as shown in the figure—to cause further increase in the relative proportion of the distal side of the peripheral annular space (120) that forms Zone B.

There may be other benefits derived from the partial separation of the peripheral annular space (120) into two Zones A and B. Compared to the first embodiment shown in FIG. 2, the radially proximate area of the peripheral annular space (120) in the area of Zone A of this embodiment has a much greater effective width than the annular channel formed by annular ring (110B) and annular subdividing disc (112) in FIG. 2. This greater width area has three benefits:

a. there is a greater space for a merging of the incoming fluid flows (flow through annular gap (129) and fluid centrifuged by rotating front disc (123)), thereby reducing flow turbulence caused by their merging,
b. this greater width which is occupied by incoming fluid flow in effect allows the circumferential normalization of flow to also occur while the fluid is still flowing in the outward direction, thereby starting the process of flow normalization earlier, and
c. urging the balancing of pressure circumferentially is facilitated by allowing the bulk circumferential velocity of a region/arc in Zone A to be different from that of Zone B in the same region/arc.

DETAILED DESCRIPTION OF THE THIRD EMBODIMENT OF THE INVENTION

Figure 4A:
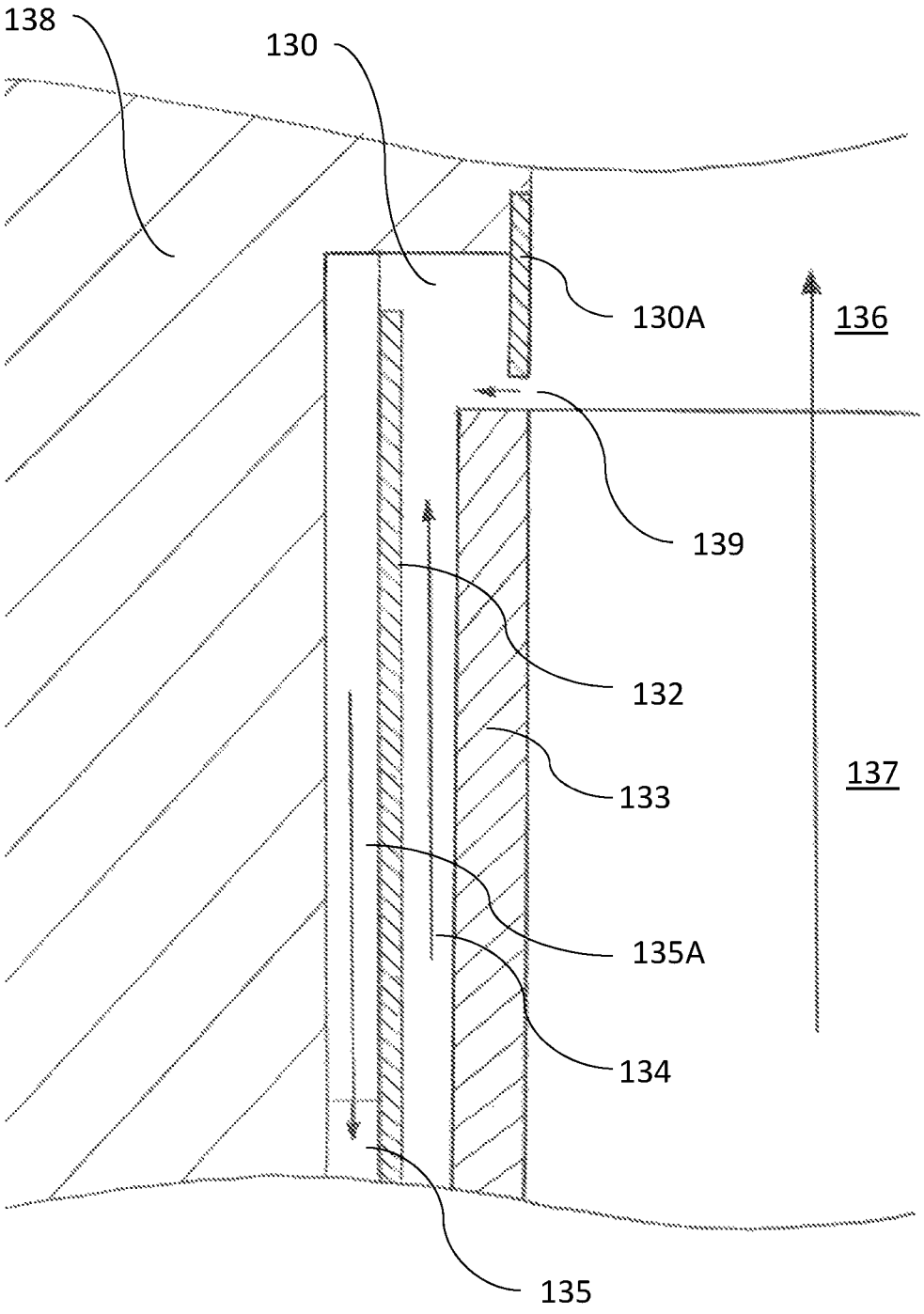
FIG. 4A is a cross sectional view of a left upper corner portion of a rotary machine (outer peripheral portion of the impeller) near an impeller fluid exit incorporating a third embodiment of the invention.
Figure 4B:
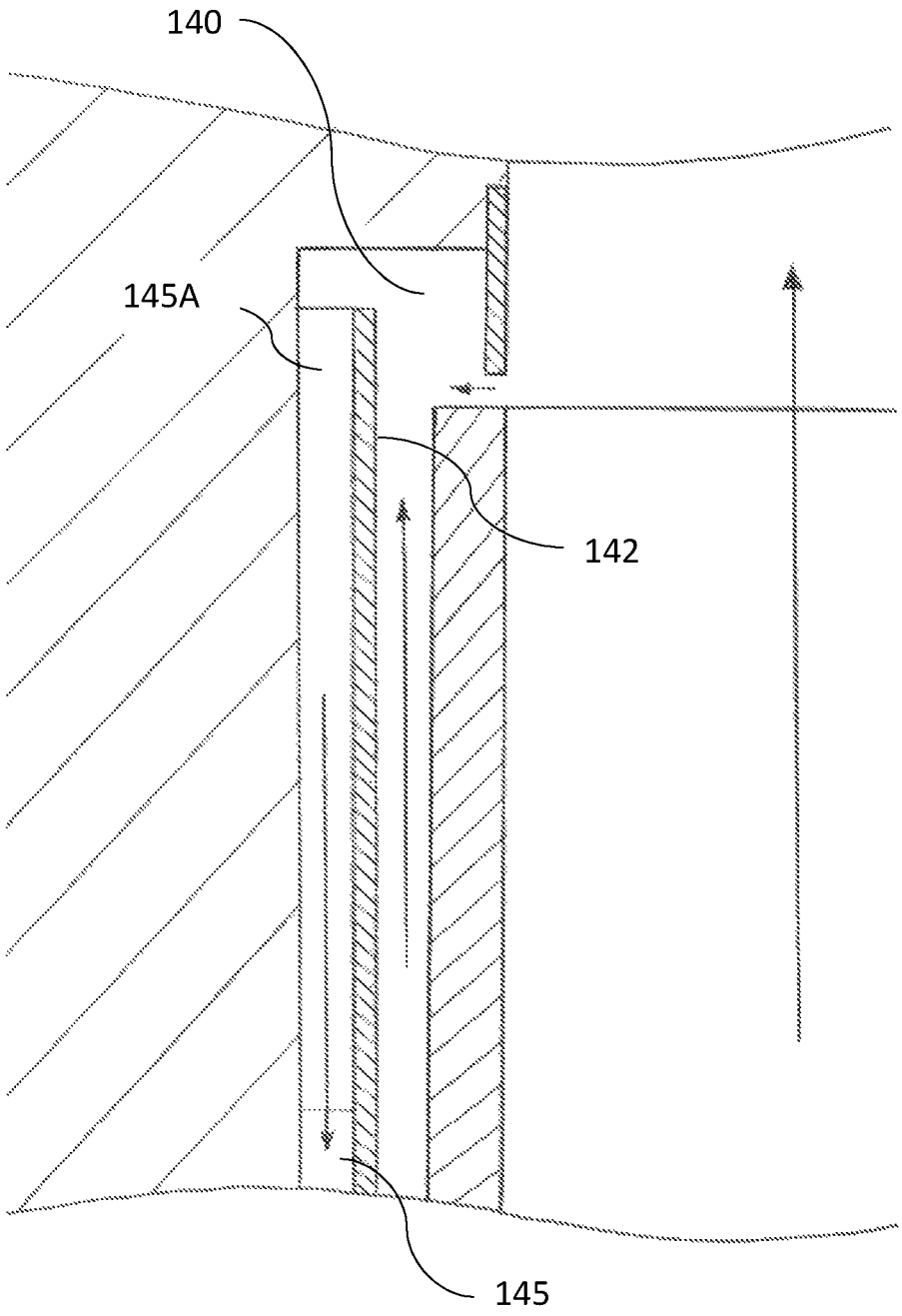
FIG. 4B is a cross sectional view of the same as FIG. 4A showing an alternative design of the third embodiment of the invention.
Figure 4C:
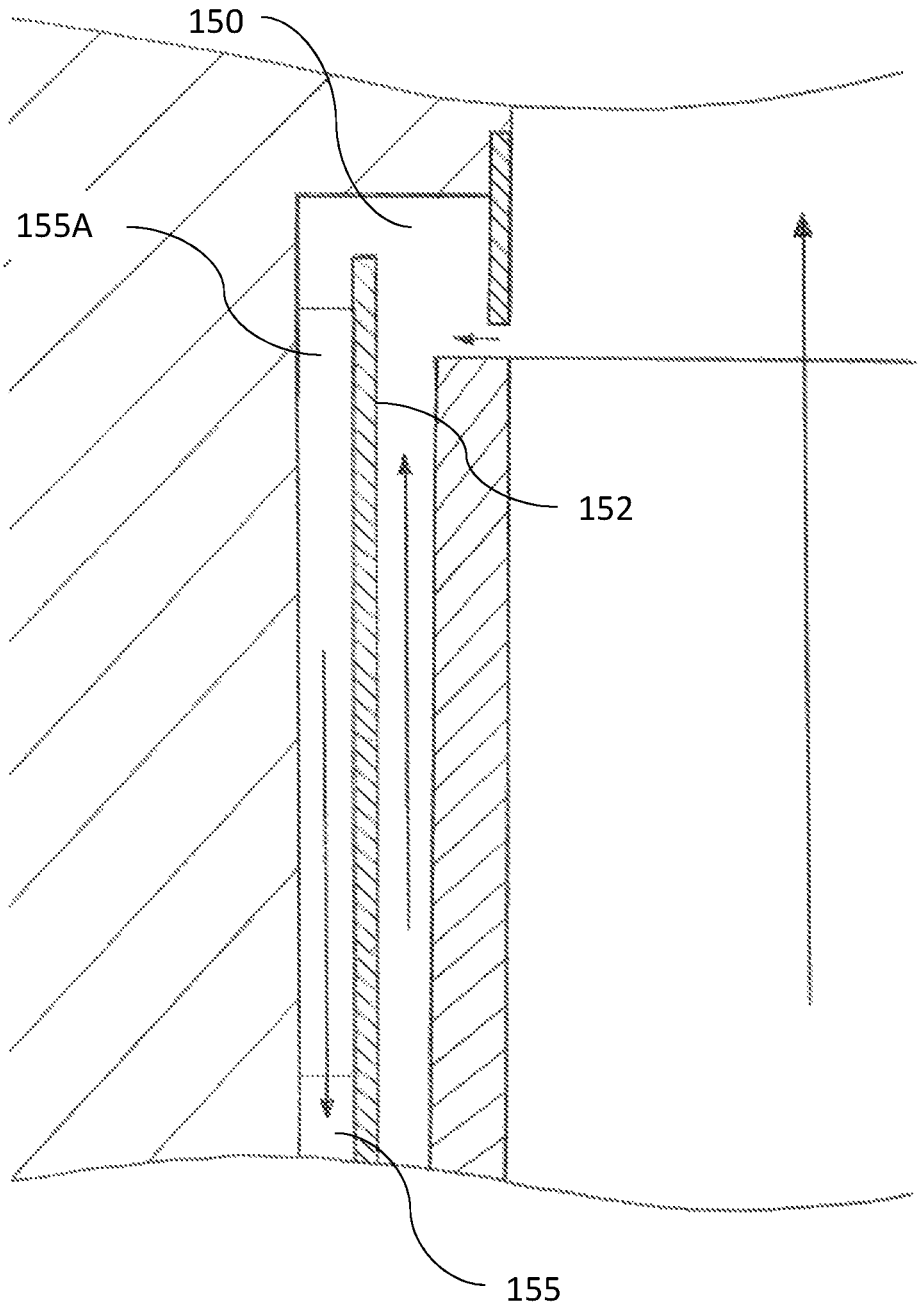
FIG. 4C is a cross sectional view of the same as FIG. 4A showing yet another alternative design of the third embodiment of the invention.

Several cross-sectional views of alternative embodiments of the third embodiment of the present invention are depicted in FIGS. 4A, 4B, and 4C. The benefits of the third embodiment of the present invention include: (1) an even more compact design, (2) further cost reduction opportunities.

The main fluid flow (137) through the rotary machine is propelled by impeller vanes having a front disc (133) defining in a periphery an impeller tip gap (139) with a peripheral annular ring (130A), which is fixedly attached to or formed together with a stationary housing (138). An annular subdividing disc (132) together with annular bypass channel (135) occupied partially of completely by redirecting vanes (135A) may be fixedly attached to the housing (138), together comprising a return channel for the secondary flow.

During operation, the rotating impeller including impeller front disc (133) urges the impeller main flow (137) into the diffuser/volute (136) that may circumferentially encompass the impeller. Transit leakage flows through an annular gap (139) with high tangential velocity. This leakage proceeds into a radially more distal region of the peripheral annular space (130). Fluid in the impeller side cavity (134) is centrifuged outward and tangentially by the rotating impeller front disc (133). Its outward and tangential momentum carries the fluid past the impeller tip and into the radially more distal region of the peripheral annular space (130). Fluid in peripheral annular space (130) exits into annular bypass channel vanes (135A), and then moves radially toward the central hub area. Annular bypass channel redirecting vanes (135A) may be contained within the annular bypass channel (135) as they may share the same annular cavity area, thereby redirecting incoming fluid having a high tangential flow component into a largely radial inward flow toward the central hub.

The embodiments shown in FIG. 4A, FIG. 4B and FIG. 4C are examples of possible designs configured for altering the extent of circumferential uniformity of the fluid achieved within the peripheral annular space (130, 140, or 150) prior to the fluid entering the annular bypass channel redirecting vanes (135A, 145A, or 155A).

In embodiments shown in FIG. 4A, the redirecting vanes (135A) extend all the way to the most peripheral area of the peripheral annular space (130) while annular subdividing disc (132) is terminated at a shorter radius to allow flow to enter from the peripheral annular space (130) into the channel (135).

In embodiments shown in FIG. 4B, the both the annular subdividing disc (142) and the redirecting vanes (145) extent radially to the same point within the peripheral annular space (140).

In embodiments shown in FIG. 4C, the annular subdividing disc (152 protrudes further outwards in the peripheral annular space (150) as compared with the redirecting vanes (155A).

The design shown in FIG. 4A may produce less circumferential uniformity than design of FIG. 4B, which in turn may be less effective in achieving circumferential uniformity than the design of FIG. 4C. This is because the exit of fluid from peripheral annular space (130) into annular bypass channel redirecting vanes (135A) is more distal from the rotor axis than that of peripheral annular space (140), and even more so from peripheral annular space (150). Fluid having the greatest component of flow normal to the streamwise flow may be at the outside of the flow, or flowing along distal portion of the peripheral annular space (130), so fluid exiting the peripheral annular space at a smaller radius may have a smaller normal component and therefore have a more two-dimensional and circumferentially uniform flow. As a general rule, the less distal the radius at entry to the annular bypass channel redirecting vanes (135A, 145A or 155A), then the greater circumferential uniformity of the fluid may be achieved.

Similarly, increased circumferential uniformity can be achieved by having the annular bypass channel redirecting vanes (145A) not occupy the most distal portion of annular bypass channel (145), as shown in FIG. 4B and FIG. 4C. In effect, this distal non-vane area of the annular bypass channel (155) provides an adjoining open peripheral annular space in parallel annular communication with peripheral annular space (150), resulting in a less distal entrance into the annular bypass channel redirecting vanes (155A) than (145A) and therefore achieving a more circumferentially uniform flow.

Methods of the Invention

The main objective of the present invention is to reduce local pressure imbalances in the secondary flows of centrifugal rotary machines, and the methods of the invention to achieve that goal involve making available an additional separate annular area or space to permit the circumferential balancing of pressure (peripheral annular space). The methods include providing this peripheral annular space to be low in resistance to flow to encourage the migration of fluid from high-pressure areas to low-pressure areas, implementing the function of circumferential balancing. The methods include steps of providing this peripheral annular space in the periphery of the impeller side cavities, the area with the highest degree of distortion in flow and pressure and therefore the area where the most impact can be made. The methods also include a step of providing the outer radial surface of the peripheral annular space to be positioned radially more distal than the impeller tip, resulting in incoming fluid (transit leakage fluid and fluid centrifuged by the rotating impeller shroud) naturally flowing into the peripheral annular space given its tangential momentum. The methods further include steps of providing the ability to vary the resistance to flow around the peripheral annular space in efforts to adjust or compensate for the peripheral circumferential imbalances caused by the tongue(s) of the diffuser/volute.

The methods further include steps of providing the ability to alter the bulk swirl velocity of fluid at different radial bands within the peripheral annular space by altering its width. The methods further include steps of providing the ability to vary the extent of circumferential imbalances reduction within the peripheral annular space and bypass channel vanes by altering the radial difference between the peripheral surface of the peripheral annular space and the entrance to the bypass channel redirecting vanes. This in effect allows varying the extent of normalization of the fluid prior to entry into the bypass channel. The methods further include steps of providing a side-by-side dual-zone peripheral annular space having communication at its perimeter to permit the stratification of the incoming fluid to be quasi-isolated from that of outgoing fluid. This in turn allows circumferential balancing given the varying flow qualities of outward flowing fluid (incoming fluid) vs. that gravitating toward lower radius (outgoing fluid), thereby permitting the tailoring (i.e., width, flow direction, etc.) of each space having different flow qualities to its own function.

It is contemplated that any embodiment discussed in this specification can be implemented with respect to any method of the invention, and vice versa. It will be also understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic(s), propertie(s), method/process steps or limitation(s)) only.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12, 15, 20 or 25%.

All of the devices and/or methods disclosed and claimed herein can be made and executed without undue experimentation in light of the present disclosure. While the devices and methods of this invention have been described in terms of preferred embodiments, it will be apparent to those of skill in the art that variations may be applied to the devices and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

We claim:

1. A rotary machine, said rotary machine comprising:

a housing containing a fluid inlet and supporting a central shaft rotatably connected therein, said housing containing a fluid outlet and a peripheral annular ring spaced concentrically and radially away from said central shaft and adjacent to said fluid outlet, said rotary machine further comprising an impeller mounted on said central shaft, said impeller having at least one radial surface with respect to said central shaft, said housing having at least one interior wall surface proximate to said at least one radial surface of said impeller, such that a cavity is defined therebetween, said impeller forming an impeller tip gap between an outer edge of said at least one radial surface of said impeller and said peripheral annular ring of said housing, said rotary machine further comprising:

an annular subdividing disc fixedly attached to said housing for segmenting a fluid flow in said cavity into a first fluid flow between said annular subdividing disc and said at least one interior wall surface of said housing, and a second fluid flow between said annular subdividing disc and said at least one radial surface of said impeller, and an open peripheral annular space formed in said housing as an extension of said cavity in a further distant peripheral direction away from said central shaft and beyond said annular subdividing disc, said open peripheral annular space located between an extension of said at least one interior wall surface of said housing in said further distant peripheral direction and said outer edge of said at least one radial surface of said impeller, such that said peripheral annular ring separates said open peripheral annular space from said fluid outlet, said open peripheral annular space having a perimeter side defined by said extension of said at least one interior wall surface of said housing and located further radially distant from said central shaft than said impeller tip gap, said open peripheral annular space in fluid communication with each of said first fluid flow and said second fluid flow of said cavity, said open peripheral annular space located adjacent to and in fluid communication with said impeller tip gap, such that said open peripheral annular space is configured to receive tangential fluid flow via said impeller tip gap and circumferential fluid flow via said cavity as said impeller rotates, said open peripheral annular space shaped and sized to allow fluid to move tangentially throughout an entire periphery of said housing prior to transforming into said first fluid flow and said second fluid flow in said cavity, thereby reducing local fluid pressure pulsations and causing an averaging of fluid pressure and fluid flow circumferentially within said open peripheral annular space, and such that said fluid flow in said cavity is characterized by reduced pressure variations around a circumference of said rotary machine so as to improve a rotational balance thereof.

2. The rotary machine as in claim 1, further comprising at least one flow redirecting vane positioned between said annular subdividing disc and said at least one interior wall surface of said housing.

3. The rotary machine as in claim 1, wherein said open peripheral annular space is formed with an increased width along said at least one interior wall surface of said housing that exceeds a width of said cavity.

4. The rotary machine as in claim 1, wherein said annular subdividing disc comprises a disc protrusion portion that extends into said open peripheral annular space so as to partially divide said open peripheral annular space into two adjacent peripheral annular zones.

5. The rotary machine as in claim 1, wherein a cross-sectional area of said open peripheral annular space is altered adjacent to one or more volute tongues of said rotary machine.

6. A method for a rotary machine, said method comprising:

step (a)—providing said rotary machine with a housing containing a fluid inlet and supporting a central shaft rotatably connected therein, said housing containing a fluid outlet and a peripheral annular ring spaced concentrically and radially away from said central shaft and adjacent to said fluid outlet, and an impeller mounted on said central shaft, said impeller having at least one radial surface with respect to said central shaft, said housing having at least one interior wall surface proximate to said at least one radial surface of said impeller, such that a cavity is defined therebetween, said impeller forming an impeller tip gap between an outer edge of said at least one radial surface of said impeller and said peripheral annular ring of said housing, step (b)—segmenting a fluid flow in said cavity using an annular subdividing disc fixedly attached to said housing into a first fluid flow between said annular subdividing disc and said at least one interior wall surface of said housing, and a second fluid flow between said annular subdividing disc and said at least one radial surface of said impeller, step (c)—forming an open peripheral annular space in said housing as an extension of said cavity in a further distant peripheral direction away from said central shaft and beyond said annular subdividing disc, said open peripheral annular space located between an extension of said at least one interior wall surface of said housing in said further distant peripheral direction and said outer edge of said at least one radial surface of said impeller, such that said peripheral annular ring separates said open peripheral annular space from said fluid outlet, said open peripheral annular space having a perimeter side defined by said extension of said at least one interior wall surface of said housing and located further radially distant from said central shaft than said impeller tip gap, said open peripheral annular space in fluid communication with each of said first fluid flow and said second fluid flow of said cavity, said open peripheral annular space located adjacent to and in fluid communication with said impeller tip gap, such that said open peripheral annular space is configured to receive tangential fluid flow via said impeller tip gap and circumferential fluid flow via said cavity as said impeller rotates, said open peripheral annular space is shaped and sized to allow fluid to move tangentially throughout an entire periphery of said housing prior to transforming into said first fluid flow and said second fluid flow in said cavity, and step (d)—reducing local fluid pressure pulsations and causing an averaging of fluid pressure and fluid flow circumferentially within said open peripheral annular space, and such that said fluid flow in said cavity is characterized by reduced pressure variations around a circumference of said rotary machine so as to improve a rotational balance thereof.

7. The method as in claim 6, further comprising step (e)—directing said first fluid flow toward said central shaft via at least one redirecting vanes.

8. The method as in claim 6, wherein step (c) further comprises adjusting a bulk swirl velocity in said open peripheral annular space by increasing a width of said open peripheral annular space along said at least one interior wall surface of said housing such that said width of said open peripheral annular space exceeds a width of said cavity.

9. The method as in claim 6, wherein said step (d) further comprises varying flow resistance circumferentially around said open peripheral annular space to compensate for pressure imbalances caused by one or more volute tongues of said rotary machine.

10. The rotary machine as in claim 1, further comprising an impeller wear seal adjacent to said fluid inlet, such that said cavity extends from said impeller wear seal to said open peripheral annular space, wherein an inner radius of said impeller wear seal is equal to or greater than one half of a distance between said impeller wear seal and said outer edge of said at least one radial surface of said impeller, and less than a radius of said impeller.

11. The rotary machine as in claim 1, further comprising a volute downstream from said impeller and said fluid outlet, wherein said open peripheral annular space is defined by an outer radius that is equal to or less than a radius of said volute.

12. The rotary machine as in claim 1, wherein said open peripheral annular space is defined by a width between one and three times larger than a combination of:

a distance between said annular subdividing disc and said at least one radial surface of said impeller, and a distance between said annular subdividing disc and said at least one interior wall surface of said housing.

* * * * *